US005934124A

United States Patent [19]

Yasuhara

[11] Patent Number: 5,934,124

[45] Date of Patent: Aug. 10, 1999

[54] CYLINDER LOCK

[75] Inventor: Nobuyoshi Yasuhara, Aichi, Japan

[73] Assignee: Kabushiki Kaisha Tokai Rika Denki Seisakusho, Aichi, Japan

[21] Appl. No.: 08/703,681

[22] Filed: Aug. 27, 1996

Related U.S. Application Data

[63] Continuation of application No. 08/343,914, Nov. 17, 1994, abandoned.

[30] Foreign Application Priority Data

Nov. 22, 1993 [JP] Japan ..... 5-291631

[51] Int. Cl.[6] ..... E05B 27/00

[52] U.S. Cl. ..... 70/492; 70/377; 70/392; 70/464

[58] Field of Search ..... 70/421, 367, 369, 70/376, 377, 392, 492, 490

[56] References Cited

U.S. PATENT DOCUMENTS

| | | | |
|---|---|---|---|
| 1,725,557 | 8/1929 | Baird | 70/377 |
| 1,805,891 | 5/1931 | Shinn | 70/369 |
| 1,906,701 | 5/1933 | Maxwell et al. | 70/421 |
| 1,958,603 | 5/1934 | Bacon | 70/421 |
| 1,969,012 | 8/1934 | Jacobi | 70/421 |
| 1,990,934 | 2/1935 | Falk | 70/377 |
| 3,713,311 | 1/1973 | Oliver et al. | 70/369 |
| 4,320,639 | 3/1982 | Kleefeldt et al. . | |
| 4,399,674 | 8/1983 | Tsai | 70/421 |
| 4,400,954 | 8/1983 | Nakamoto et al. | 70/377 |
| 4,644,768 | 2/1987 | Nowak et al. | 70/377 |
| 5,134,871 | 8/1992 | Makino et al. . | |
| 5,653,131 | 8/1997 | Shibata et al. | 70/252 |

FOREIGN PATENT DOCUMENTS

| | | |
|---|---|---|
| 2 457 951 | 12/1980 | France . |
| 1 493 687 | 9/1987 | France . |

*Primary Examiner*—Darnell M. Boucher
*Attorney, Agent, or Firm*—Finnegan, Henderson, Farabow, Garrett & Dunner, L.L.P.

[57] ABSTRACT

A lock piece is provided in the inner part of a tumbler. Size of a clearance formed between the side of a lock groove engaging portion of the lock piece and the side of a lock groove is determined to be smaller than size of a clearance formed between the side of a lock condition holding portion of the tumbler and the side of a lock groove. When the key is inserted being given a torque in the rotating direction, the lock groove engaging portion is engaged with the side of the lock groove, and the lock condition holding portion of the tumbler is maintained to be separate from the side of the lock groove. Due to the foregoing, the lock condition holding portion is prevented from being caught on the side of the lock groove.

2 Claims, 7 Drawing Sheets

CYLINDER LOCK

This is a continuation of application Ser. No. 08/343,914, filed Nov. 17, 1994, now abandoned.

BACKGROUND OF THE INVENTION

1. Field of the Invention

The present invention is to provide a cylinder lock in which a rotor is rotatably accommodated in a rotor case.

2. Related Art

Conventionally, in this type cylinder lock, tumblers are movably inserted into a plurality of tumbler insertion holes provided in the rotor, and when a key is not inserted into the keyhole, a lock condition holding portion of each tumbler is engaged with a lock groove in the rotor case, so that the rotor can be maintained in a lock condition.

According to the device described above, when the key is inserted into the keyhole, a protruding and cutout portion of the key is engaged with the lock condition release member of the tumbler. In the process of insertion of the key, each tumbler is pushed upward or downward along the protruding and cutout portion of the key. After the completion of key inserting operation, the protruding and cutout portion of the key is engaged with a predetermined lock condition release portion of the tumbler, and the tumbler is moved so that the lock condition holding portion can be released from the lock groove. Next, the key is operated so as to rotate the rotor.

In this connection, when an operator inserts the key into the keyhole, he is well aware of the rotational operation of the key to be conducted after the insertion of the key. Therefore, he tends to insert the key into the keyhole while a torque is applied to the key. However, in the conventional construction described above, when the key is inserted into the keyhole while a torque is applied to the key, the tumblers which are pushed upward or downward come into pressure contact with a side of the lock groove. Therefore, even after the key inserting operation has been completed, the tumblers can not be moved due to a frictional force generated between the tumblers and the side of the lock groove. For this reason, there is a possibility that the lock condition holding portion is not disengaged from the lock groove. When the lock condition holding portion is not disengaged from the lock groove, the next rotational operation of the key can not be smoothly performed.

SUMMARY OF THE INVENTION

The present invention has been achieved in view of the above circumstances. It is an object of the present invention to provide a cylinder lock in which the rotational operation of the key can be smoothly performed even after the key has been inserted into the keyhole while a torque is applied to the key.

The present invention is to provide a cylinder lock comprising: a rotor case, in the inner circumferential portion of which a lock groove is provided; a rotor rotatably accommodated in the rotor case, the rotor having a keyhole extending in the axial direction and a tumbler insertion hole extending in the radial direction; a tumbler movably inserted into the tumbler insertion hole of the rotor; a lock condition holding portion provided in the tumbler for holding the rotor in a lock condition by engaging with the lock groove of the rotor case when the key is not inserted into the keyhole; a lock condition release portion provided in the tumbler, the lock condition release portion allowing the tumbler to move so that the lock condition holding portion is disengaged from the lock groove when the key is inserted into the keyhole and the lock condition release portion is engaged with a protruding and cutout portion of the key; a lock piece movably provided in the rotor, the lock piece being located in the inner part of the tumbler; and a lock groove engaging portion provided in the lock piece, the lock groove engaging portion engaging with the lock groove of the rotor case when the key is not inserted into the keyhole, wherein a clearance between the side of the lock groove engaging portion of the lock piece and the side of the, lock groove is determined to be smaller than a clearance between the side of the lock condition holding portion and the side of the lock groove in order to hold the lock condition holding portion of the tumbler to be separate from the side of the lock groove when the rotor is rotated under a lock condition, the cylinder lock further comprising a lock piece moving portion provided at least in one of the end of the key and the lock piece, wherein the lock piece moving portion forcibly moves the lock groove engaging portion coming into contact with the side of the lock groove so that the lock groove engaging portion can get out of the lock groove when the key is inserted into the keyhole.

According to the above means, when the key is inserted into the keyhole being given a torque, first, the lock groove engaging portion of the lock piece is engaged with a side of the lock groove, and the lock condition holding portion of the tumbler is held under the condition that the lock condition holding portion is separate from the side of the lock groove. Accordingly, the lock condition holding portion of the tumbler is not caught on the side of the lock groove in the process of insertion of the key. Therefore, the lock condition holding portion is smoothly pushed upward or downward along the protruding and cutout portion of the key. After the key insertion operation has been completed, the protruding and cutout portion of the key is engaged with a predetermined lock condition release portion of the tumbler, and the tumbler is moved so that the lock condition holding portion can be disengaged from the lock groove.

When the lock piece moving portion provided at least in one of the end of the key and the lock piece is engaged with the opponent, the lock groove engaging portion is forcibly moved so that the lock groove engaging portion gets out of the lock groove. Due to the foregoing, the lock groove engaging portion of the lock piece is disengaged from the lock groove, and the rotational operation of the key can be smoothly performed.

DETAILED DESCRIPTION OF THE PREFERRED EMBODIMENTS

Figure 2:
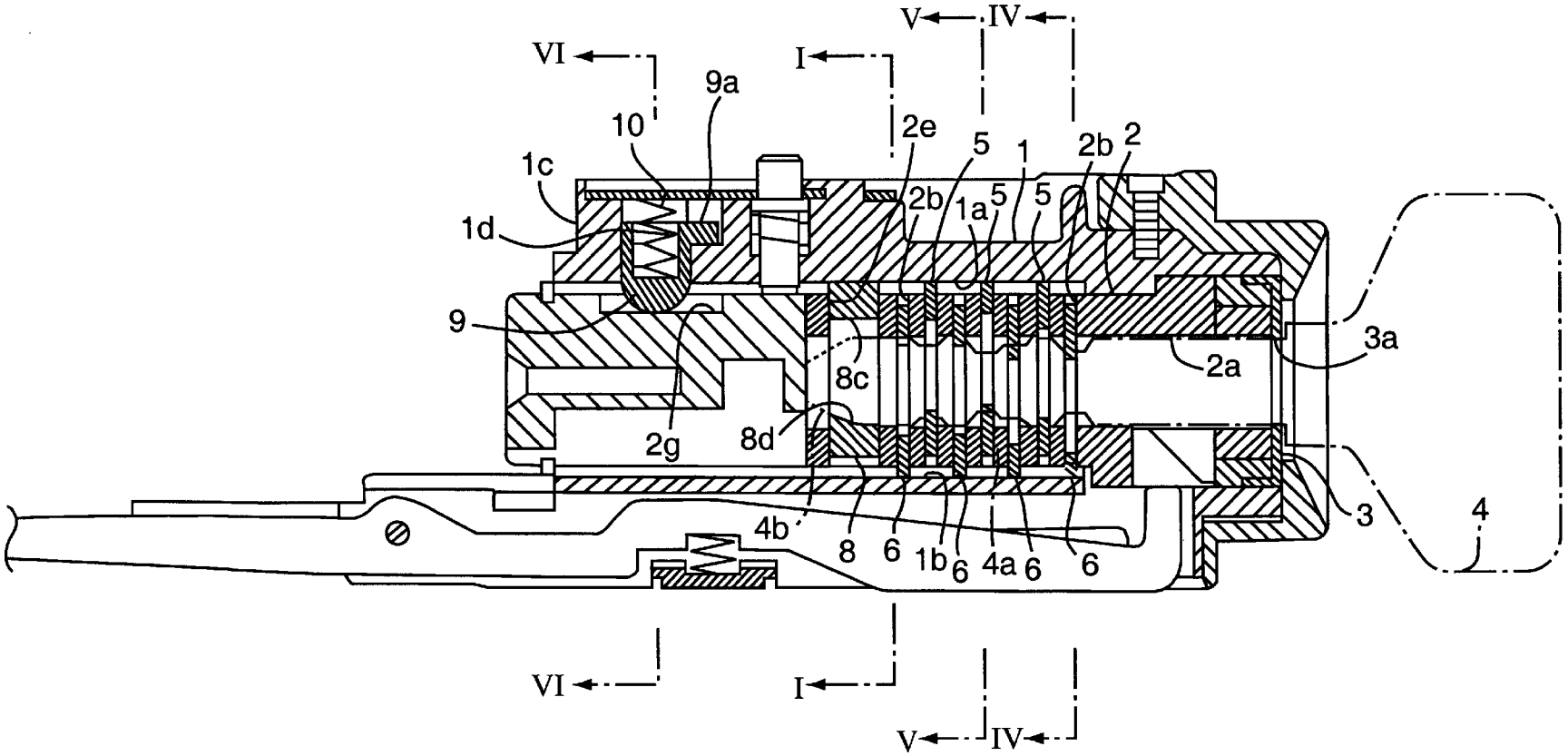
FIG. 2 is a longitudinal sectional view of the overall arrangement of the present invention.

With reference to the accompanying drawings, an example will be explained as follows in which the present invention is applied to an ignition key unit for use in an automobile. Referring to FIG. 2, a rotor 2 is rotatably accommodated in a cylindrical rotor case 1. A keyhole 2*a* is provided in this rotor 2 in the axial direction.

Figure 3:
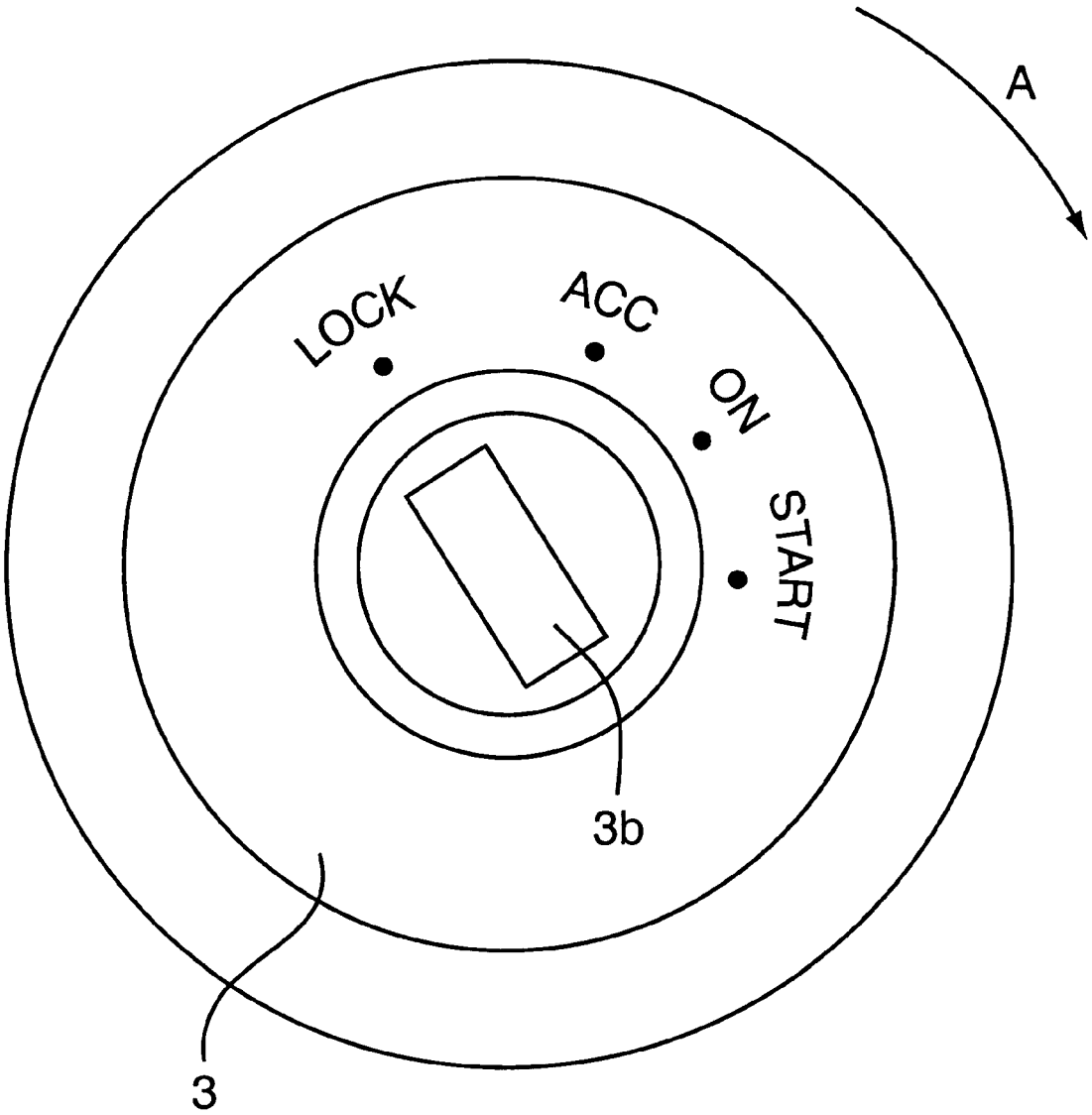
FIG. 3 is a front view of the cover of the present invention.

A front face of the rotor case 1 is covered with a cover 3. The cover 3 is provided with an opening 3*a*. When a key 4 is inserted into a keyhole 2*a* through this opening 3*a* of the cover 3 and the key 4 is rotated to the right, that is, when the key 4 is rotated in the direction shown by arrow A in FIG. 3, a starter of the engine is turned on. In this connection, as illustrated in FIG. 3, the cover 3 is provided with a shutter 3*b*. Usually, the opening 3*a* is closed by the shutter 3*b*. When the key 4 is inserted into the opening 3*a*, the shutter 3*b* is pushed and opened by the key 4. In this way, the key 4 is allowed to be inserted.

Figure 4:
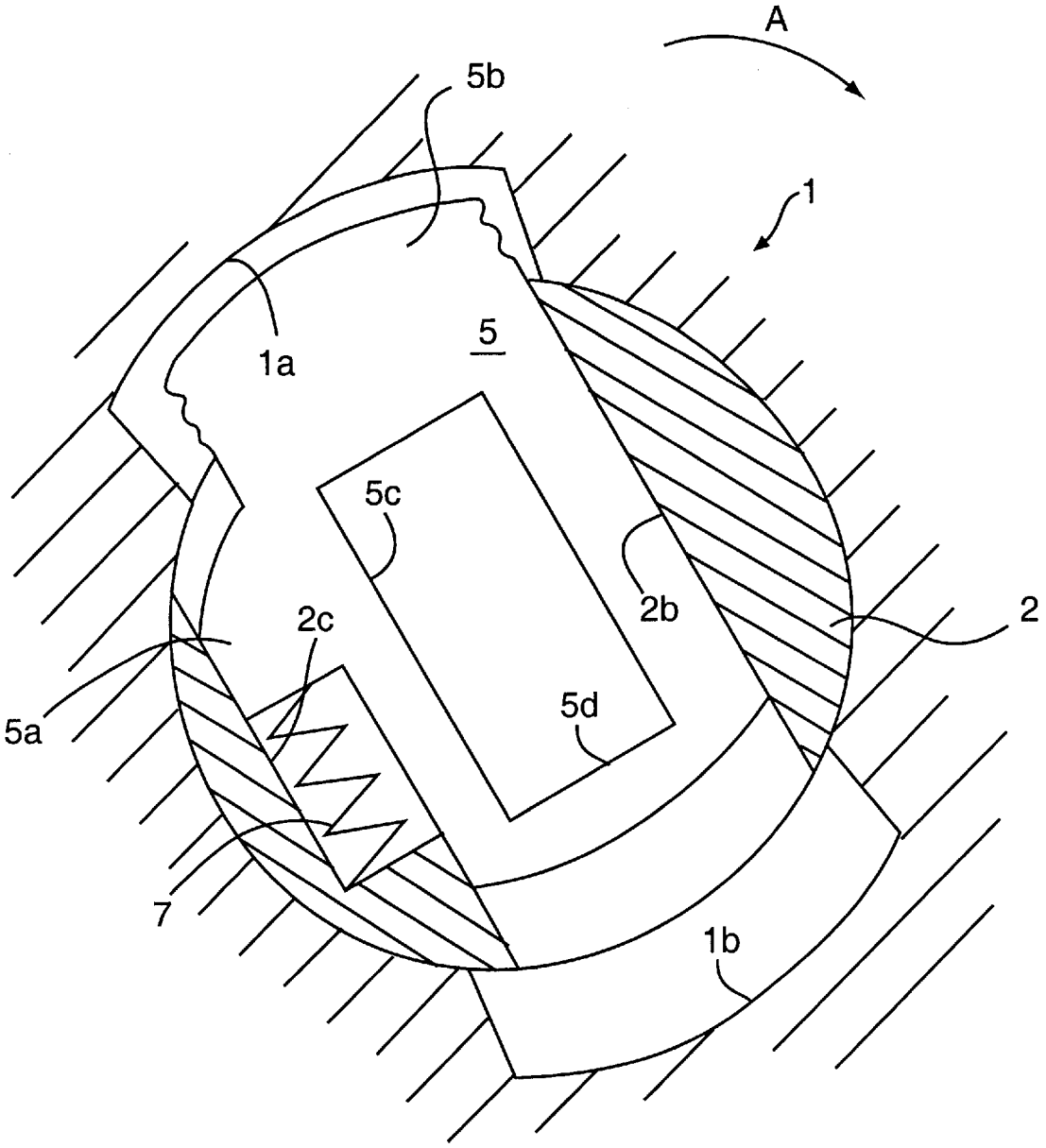
FIG. 4 is a sectional view taken on line B—B in FIG. 2.

As illustrated in FIG. 2, for example, 7 tumbler insertion holes 2*b* are provided in the rotor 2 in the radial direction. Sheet-shaped tumblers 5 and 6 are movably inserted into the tumbler insertion holes 2*b*. As illustrated in FIG. 4, in the former tumbler 5, a spring engaging portion 5*a* is protruded at an upper side position of the tumbler 5, and a lock condition holding portion. 5*b* is provided at an upper end portion of the tumbler 5.

There is provided a lock groove 1*a* on an upper side of the inner circumferential portion of the rotor case 1. In the rotor 2, there is provided a cutout portion 2*c* at a position in the tumbler insertion hole 2*b*. A spring engaging portion 5*a* of the tumbler 5 is inserted into the cutout portion 2*c* of the rotor 2. A compression coil spring 7 is interposed between the spring engaging portion 5*a* and a lower surface of the cutout portion 2*c*. Due to the foregoing construction, the tumbler 5 is protruded upward, and the lock condition holding portion 5*b* is engaged with the lock groove 1*a* in the rotor case 1.

There is provided a key insertion hole 5*c* at the center of the tumbler 5. When the key 4 is inserted into the key insertion hole 5*c*, a protruding and cutout portion 4*a* formed in a lower edge portion of the key 4 is engaged with a lower surface of the insertion hole 5*c*, and each tumbler 5 is lowered, resisting a force of the compression coil spring 7 (shown in FIG. 7). Due to the foregoing, the lock condition holding portion 5*b* of each tumbler 5 gets out of the lock groove 1*a* of the rotor case 1. As described above, the lower surface of the key insertion hole 5*c* functions as the lock condition release portion 5*d*.

Figure 5:
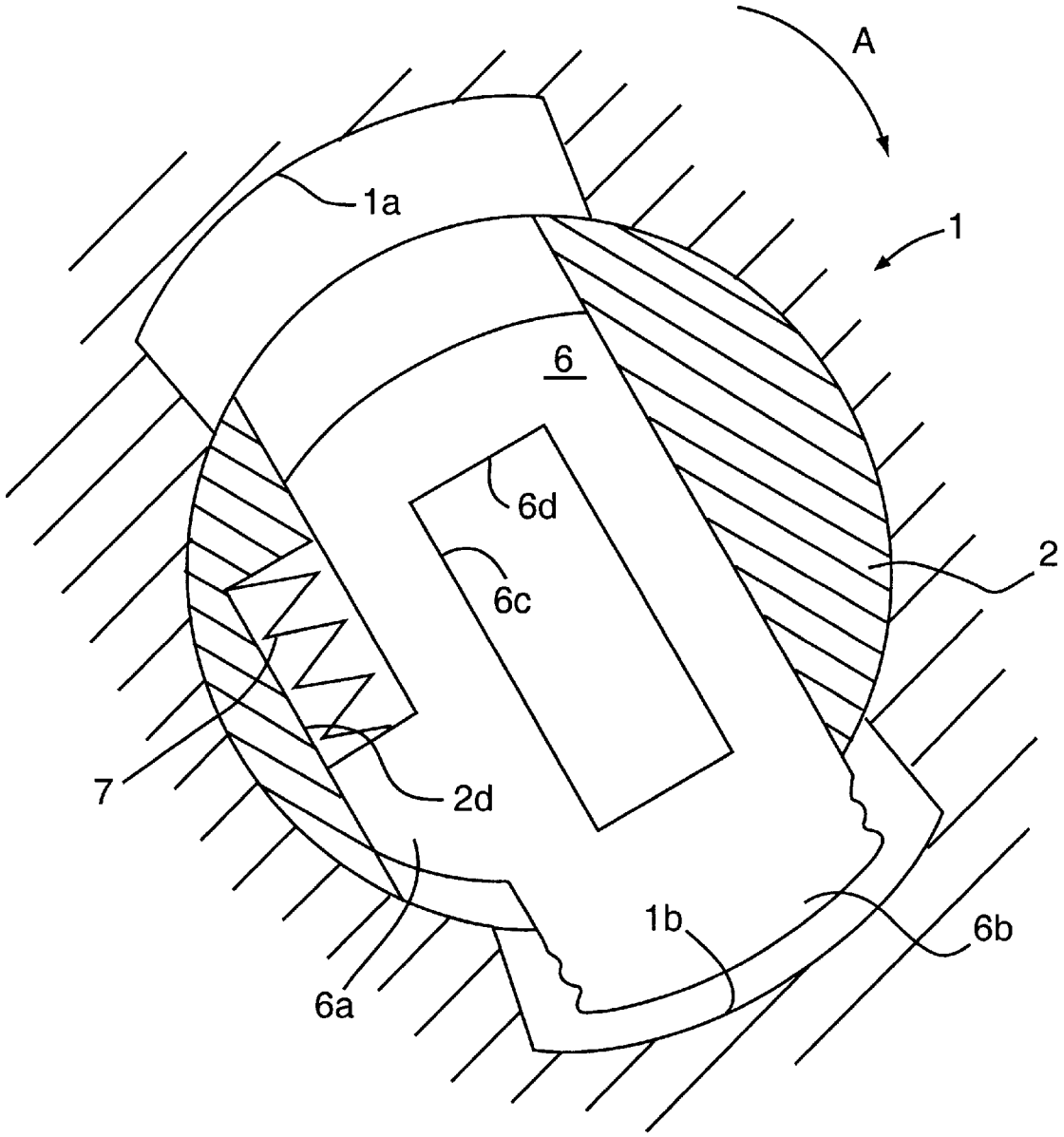
FIG. 5 is a sectional view taken on line C—C in FIG. 2.

FIG. 5 shows a tumbler 6. A different point between the tumblers 5 and 6 is that a spring engaging portion 6*a* is provided at a lower position in the side, and a lock condition holding portion 6*b* is provided at a lower end portion. Concerning the rotor case 1, the lock groove 1*b* is provided at a lower position of the inner circumferential portion. In the rotor 2, there is provided a cutout portion 2*d* into which the spring engaging portion 6*a* is inserted. The tumbler 6 is protruded downward by the compression coil spring 7 interposed between the upper surface of the cutout portion 2*d* and the spring engaging portion 6*a*. Therefore, the lock condition holding portion 6*b* is engaged with the lock groove 1*b*.

There is provided a keyhole 6*c* at a center of the tumbler 6. In this case, an upper surface of the keyhole 6*c* functions as the lock condition release portion 6*d*. In this case, when the key 4 is inserted into the keyhole 6*c*, the protruding and cutout portion 4*a* formed at an upper edge of the key 4 is engaged with the lock condition release portion 6*d*. Therefore, each tumbler 6 is pushed upward, resisting a spring force of the compression coil spring 7 (shown in FIG. 7). Due to the foregoing, the lock condition holding portion 6*b* of each tumbler 6 gets out of the lock groove 1*b* of the rotor case 1.

As illustrated in FIG. 2, a lock piece insertion hole 2*e* is formed at an inner part of 7 tumbler insertion holes 2*b* in the rotor 2. A thick lock piece 8 is movably inserted into this lock piece insertion hole 2*e*. As shown by the solid line in FIG. 1, this lock piece 8 includes a spring engaging portion 8*a* located at an upper side of the lock piece 8, and a lock groove engaging portion 8*b* located at an upper end portion of the lock piece 8.

Figure 1:
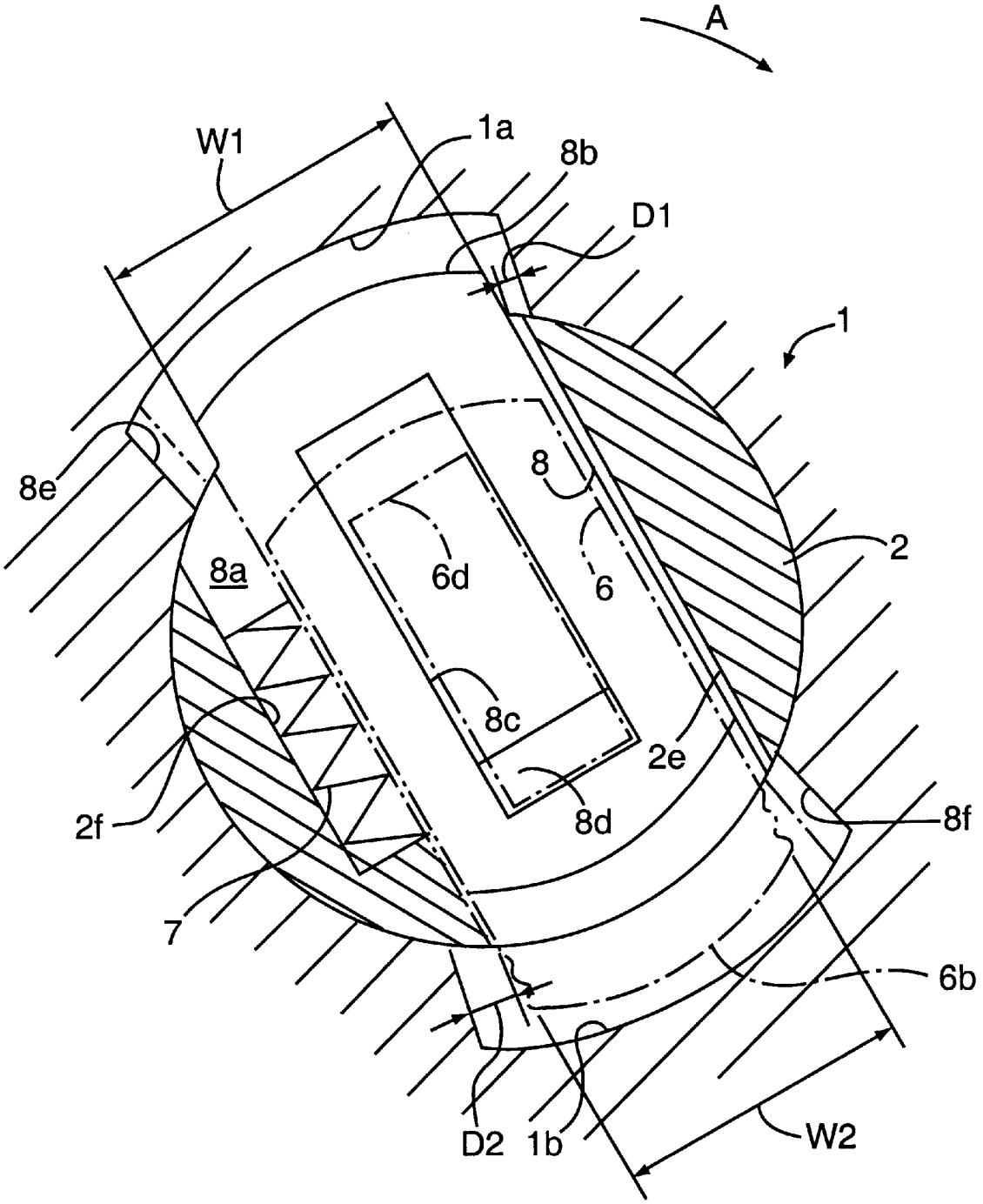
FIG. 1 is a sectional view of an example of the present invention taken on line A—A in FIG. 2.

A cutout portion 2*f* is formed in the lock piece insertion hole 2*e* of the rotor 2. The spring engaging portion 8*a* of the lock piece 8 is inserted into the cutout portion 2*f*. The compression coil spring 7 is interposed between a lower surface of the cutout portion 2*f* and the spring engaging section 8*a*. Due to the foregoing construction, the lock piece 8 is protruded upward, and the lock groove engaging portion 8*b* is engaged with the lock groove 1*a* of the rotor case 1. Width W1 of the lock groove engaging portion 8*b* of the lock piece 8 is determined to be larger than width W2 of the lock condition holding portions 5*b*, 6*b* of the tumblers 5, 6. In FIG. 1, only a relation between the lock groove engaging portion 8*b* and the lock condition holding portion 6*b* is illustrated. Due to the foregoing, size D1 of a clearance formed between a right side of the lock groove engaging portion 8*b* and a side of the lock groove 1*a* correspondingly to the rotational direction of the key 4 (the direction indicated by arrow A), is determined to be smaller than size D2 of a clearance formed between the lock condition holding portion 6*b* (5*b*) and the lock groove 1*b* (1*a*).

Consequently, when the rotor 2 is rotated under a locked condition, that is, when the rotor 2 is rotated under the condition that the lock condition holding portions 5*b*, 6*b* of the tumblers 5, 6 are engaged with the lock grooves 1*a*, 1*b* of the rotor case 1, the lock groove engaging portion 8*b* of the lock piece 8 is engaged with the right side of the lock groove 1*a*, and the left side of the lock condition holding portion 6*b* is separate from the left side of the lock groove 1*b*, and also the right side of the lock condition holding portion 5*b* is separate from the right side of the lock groove la.

In this connection, the side 8*e* of a portion (shown by the solid line in the drawing) of the lock groove 1*a* with which the lock groove engaging portion 8*b* of the lock piece 8 is engaged is extended to a direction opposite to the rotational direction as compared with a portion (shown by the two-dotted chain line in the drawing) with which the lock condition holding portion 5*b* of the tumbler 5 is engaged. Further, the side 8*f* of a portion (shown by the solid line in the drawing) opposed to a portion of the lock groove 1*b* with which the lock groove engaging portion 8*b* is engaged is extended to a direction opposite to the rotational direction as compared with a portion (shown by the two-dotted chain line in the drawing) with which the lock condition holding portion 6*b* of the tumbler 6 is engaged.

A key insertion hole 8*c* into which the key 4 is inserted is formed in the lock piece 8. In this case, when a lower surface of the key insertion hole Bc is formed into a slope as illustrated in FIG. 2, a diameter of the key insertion hole 8*c* is gradually reduced as it advances from the insertion start end to the insertion completion end. Also, a lower surface of the fore end of the key 4 is formed into a slope. Therefore, the lower surface of the fore end of the key 4 and the lower surface of the key insertion hole 8*c* function as the lock piece moving portions 4*b*, 8*d*. Consequently, when the key 4 is inserted into the key insertion hole 8*c*, the lock piece moving portion 8*d* of the lock piece 8 is pushed by the lock piece moving portion 4*b* of the key 4, so that the lock piece 8 is pushed downward.

Figure 6:
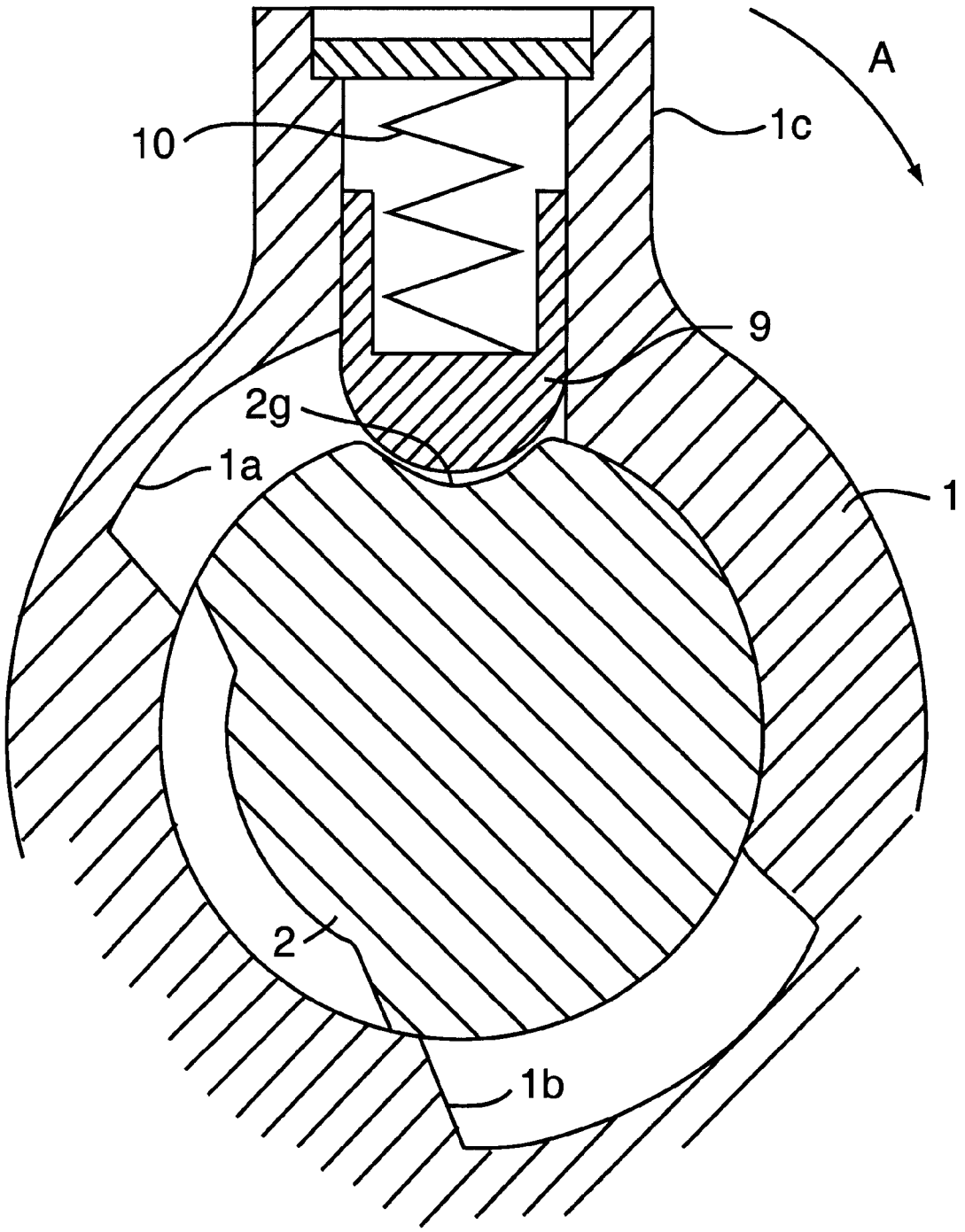
FIG. 6 is a sectional view taken on line D—D in FIG. 2.

As illustrated in FIG. 6, a protrusion 1*c* is formed in the rotor case 1. A moderation member 9 is movably accommodated in this protrusion 1*c*. A compression coil spring 10 is interposed between this moderation member 9 and a ceiling surface of the protrusion 1*c*. Also, a key way 2*g*, the section of which is arcuate, is formed in the rotor 2. The moderation member 9 is engaged with the key way 2*g* by the action of the compression coil spring 10. Due to the foregoing construction, the rotor 2 is positioned at a position defined as "Lock Position" shown in the drawing. In this connection, as illustrated in FIG. 2, a stopper 9*a* is provided in the moderation member 9. Accordingly, a protruding position at which the moderation member 9 is protruded is regulated when the stopper 9*a* comes into contact with the engaging portion 1*d* of the rotor case 1.

Next, the operation of the construction described above will be explained below. First, in FIG. 2, the key 4 is inserted into the opening 3*a* of the cover 3. Then the shutter 3*b* is opened being pushed by the key 4, and the key 4 is inserted into the keyhole 2*a* of the rotor 2. When the protruding and cutout portion 4*a* of the key 4 is engaged with the lock condition release portions 5*d*, 6*d*, the tumblers 5, 6 are pushed upward or downward in the process of insertion of the key 4.

Figure 7:
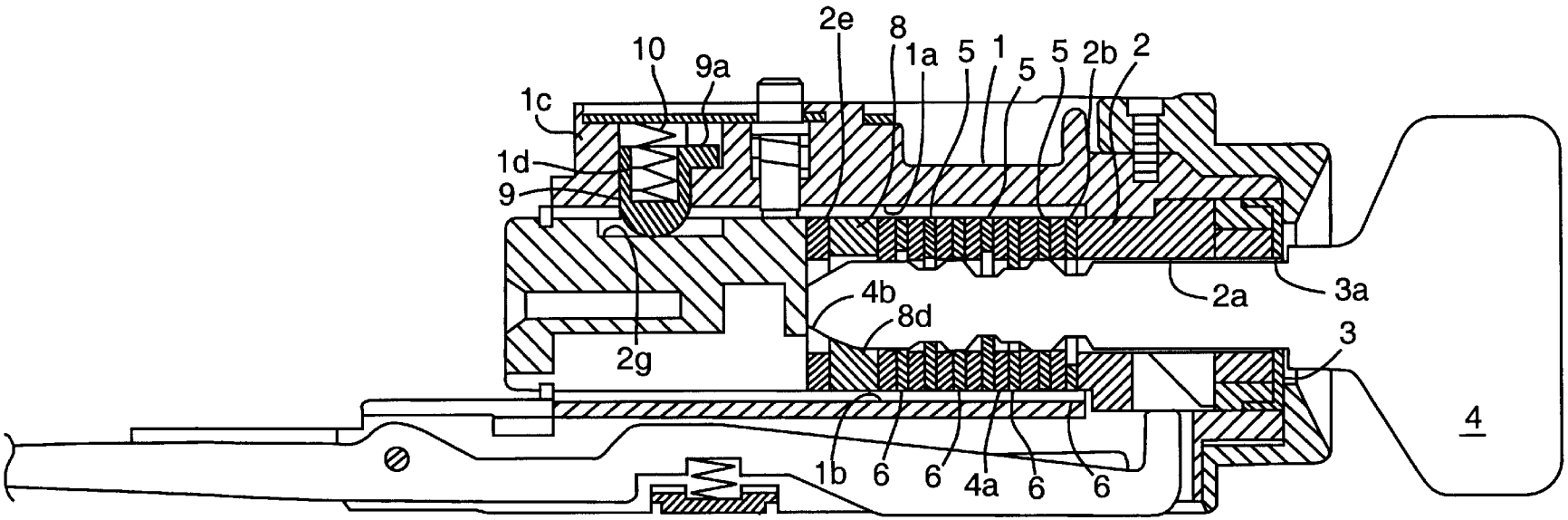
FIG. 7 is a sectional view corresponding to FIG. 2 for explaining the operation.

When the key 4 is completely inserted, the protruding and cutout portion 4*a* of the key 4 is engaged with the lock condition release portion 5*d* of the predetermined tumbler 5 and the lock condition release portion 6*d* of the predetermined tumbler 6. As a result, the tumbler 5 is moved downward, and the tumbler 6 is moved upward. Due to the foregoing operation, as illustrated in FIG. 7, the lock condition holding portion 5*b* of the tumbler 5 gets out of the lock groove 1*a*, and the lock condition holding portion 6*b* of the tumbler 6 gets out of the lock groove 1*b*.

At the same time, the lock piece moving portion 4*b* of the key 4 is engaged with the lock piece moving portion 8*d* of the lock piece 8, and the lock piece moving portion 4*b* of the key 4 pushes the lock piece moving portion 8*d* of the lock piece 8. Due to the foregoing, the lock piece 8 is forcibly lowered. Accordingly, the lock groove engaging portion 8*b* of the lock piece 8 gets out of the lock groove 1*a*, so that the rotor 2 is allowed to rotate. Consequently, the key 4 is operated so that it is rotated to the right. In this connection, when thus rotated key 4 is returned to the left, the key way 2*g* of the rotor 2 is engaged with the moderation member 9, and the rotor 2 is positioned at a position defined as "Lock Position".

In this connection, this cylinder lock is constructed in such a manner that the key 4 is rotated to the right from "Lock Position" to "ACC position" and the like. Accordingly, the operator sometimes inserts the key 4 into the keyhole while a torque is applied to the key so that the key 4 is rotated to the right. Then, in FIG. 1, the lock groove engaging portion 8*b* of the lock piece 8 is engaged with the right side of the lock groove 1*a*.

In this case, size D1 of the clearance between the side of the lock groove engaging portion 8*b* and the side of the lock groove 1*a* is determined to be smaller than size D2 of the clearance between the right side of the lock condition holding portion 5*b* and the right side of the lock groove 1*a*, and also size D1 is determined to be smaller than size D2 of the clearance between the left side of the lock condition holding portion 6*b* and the left side of the lock groove 1*b*. Therefore, the lock condition holding portions 5*b* and 6*b* are maintained to be separate from the concerned sides. Consequently, the tumblers 5, 6 are pushed upward or downward along the protruding and cutout portion 4*a* of the key 4 while the lock condition holding portions 5*b*, 6*b* are not caught on the sides of the lock grooves 1*a*, 1*b* in the process of insertion of the key 4. After the inserting operation of the key 4 has been completed, the protruding and cutout portion 4*a* of the key 4 is engaged with the predetermined lock condition release portions 5*d*, 6*d*, and the lock condition release portion 5*b* is released from the lock groove 1*a*, and also the lock condition holding portion 6*b* is released from the lock groove 1*b*. Therefore, the tumblers 5, 6 are smoothly moved.

At the same time, as illustrated in FIG. 7, the lock piece moving portion 4*b* of the key 4 is engaged with the lock piece moving portion 8*d* of the lock piece 8, and the lock piece 8 is forcibly lowered. Due to the foregoing, the lock groove engaging portion 8*b* of the lock piece 8 gets out of the lock groove 1*a*, and the lock groove engaging portion 8*b* is released from the lock groove 1*a*. Accordingly, at a point of time when the insertion of the key 4 has been completed, the lock condition of the rotor 2 is quickly released. As a result, the next rotational operation of the key 4 can be smoothly performed.

In this connection, in the above example, the slope-shaped lock piece moving portions 8*d*, 4*b* are provided at the end of the lock piece 8 and also the end of the key 4. However, a lower surface of the end of the key 4 may be formed to be flat so that only the slope of the lock piece 8 is used as the lock piece moving portion 8*d*, or alternatively a lower surface of the key insertion hole 8*c* of the lock piece 8 may be formed to be flat so that only the slope of the key 4 is used as the lock piece moving portion 4*b*.

In the above example, the rotor 2 is rotated by the key 4 in which the protruding and cutout portion 4*a* is provided outside on both the upper and lower surfaces. However, it should be noted that the present invention is not limited to this type of key, and the rotor 2 may be rotated by the key 4 in which the protruding and cutout portion 4*a* is provided inside.

In the above example, the present invention is applied to the ignition key unit, however, the present invention is not limited to the specific example. For example, the present invention may be applied to a key to the door of an automobile.

As can be seen from the above explanation, according to the cylinder lock of the present invention, when a key is inserted into a keyhole while a torque is applied to the key, the lock groove engaging portion of the lock piece is engaged with a side of the lock groove, and then the lock condition holding portion of the tumbler is maintained to be separate from the side. Therefore, the lock condition holding portion of the tumbler is prevented from being caught in the lock groove. As a result, even if the key is inserted into the keyhole while a torque is applied to it, the rotational operation of the key can be carried out without causing any problems.

What is claimed is:

1. A cylinder lock comprising:

a rotor case having an elongated cylindrical slot having a longitudinal axis and at least one radially extending lock groove parallel with and opening into the cylindrical slot, the each of the lock grooves having two radially extending and angulary spaced sides;

a rotor coaxially disposed in the cylindrical slot and rotatable about the longitudinal axis, the rotor having a coaxial keyhole opening into the rotor, a radially extending lock piece insertion hole, and a plurality of radially extending tumbler insertion holes between the coaxial keyhole and the lock piece insertion hole;

a plurality of elongated and substantially planar tumblers radially slidable in respective tumbler insertion holes, each tumbler having a thickness and a coplanar length and width, both the coplanar length and width extending transverse to the longitudinal axis of the cylindrical slot, one end of each of the tumblers comprising a lock condition holding portion having opposing sides, each lock condition holding portion being engageable with the angulary spaced sides of the at least one lock groove, the other end of each tumbler comprising a lock condition release portion engagable with protrusions and cutouts of a key such that a protrusion engaging the lock condition release portion pushes the tumbler radially inwards so that the lock condition holding portion of the tumbler is no longer engagable with a lock groove; and a substantially planar lock piece radially slidable in the lock piece insertion hole, the lock piece having a thickness and a coplanar length and width, the coplanar length and width both extending transverse to the longitudinal axis of the cylindrical slot, one end of the lock piece comprising a lock groove engaging portion having opposing sides, the lock groove engaging portion being engagable with the angulary spaced sides of a lock groove, the other end of the lock piece comprising a lock piece moving portion engagable with an end portion of the key such that the end portion of the key engaging the lock piece moving portion pushes the lock piece radially inwards so that the lock groove engaging portion of the tumbler is no longer engagable with a one lock groove;

wherein the lock groove engaging portion of the lock piece is wider than the lock condition holding portions of the plurality of tumblers so that unless the key is completely inserted into the cylinder lock, the lock piece limits rotational movement of the rotor thereby preventing the plurality of tumblers from catching on the sides of at least one lock groove.

2. A cylinder lock according to claim 1, wherein there are two radially opposed lock grooves, and each of the lock condition holding portions is engageable with one of the lock grooves, respectively.

* * * * *

UNITED STATES PATENT AND TRADEMARK OFFICE

CERTIFICATE OF CORRECTION

PATENT NO. : 5,934,124
DATED : August 10, 1999
INVENTOR(S) : Nobuyoshi YASUHARA

It is certified that error appears in the above-identified patent and that said Letters Patent is hereby corrected as shown below:

Claim 1, column 7, line 17, "engagable" should read --engageable--.
Claim 1, column 7, line 21, "engagable" should read --engageable--.
Claim 1, column 8, line 5, "engagable" should read --engageable--.
Claim 1, column 8, line 7, "engagable" should read --engageable--.
Claim 1, column 8, line 11, "engagable" should read --engageable--.

Signed and Sealed this

Twenty-fourth Day of October, 2000

*Attest:*

Q. TODD DICKINSON

*Attesting Officer*

*Director of Patents and Trademarks*